United States Patent [19]

McCormick et al.

[11] 4,138,622

[45] Feb. 6, 1979

[54] HIGH TEMPERATURE ELECTRONIC GAIN DEVICE

[75] Inventors: J. Byron McCormick; Steven W. Depp, both of Los Alamos, N. Mex.; Douglas J. Hamilton; William J. Kerwin, both of Tucson, Ariz.

[73] Assignee: The United States of America as represented by the United States Department of Energy, Washington, D.C.

[21] Appl. No.: 821,870

[22] Filed: Aug. 4, 1977

[51] Int. Cl.[2] ..... H01J 1/46; H01J 21/10; H01K 11/00

[52] U.S. Cl. ..... 313/306; 313/250; 313/309

[58] Field of Search ..... 313/250, 306, 309

[56] References Cited

U.S. PATENT DOCUMENTS

| | | | |
|---|---|---|---|
| 3,066,236 | 11/1962 | Sandbank | 313/250 |
| 3,320,464 | 5/1967 | Dill | 313/250 X |
| 3,463,978 | 8/1969 | Varadi | 313/250 |
| 3,748,522 | 7/1973 | Geppert | 313/337 |
| 3,824,478 | 7/1974 | Mueller | 313/338 |
| 3,978,364 | 8/1976 | Dimeff et al. | 313/306 |

*Primary Examiner*—Saxfield Chatmon, Jr.
*Attorney, Agent, or Firm*—Dean E. Carlson; Jerome B. Rockwood

[57] ABSTRACT

An integrated thermionic device suitable for use in high temperature, high radiation environments. Cathode and control electrodes are deposited on a first substrate facing an anode on a second substrate. The substrates are sealed to a refractory wall and evacuated to form an integrated triode vacuum tube.

5 Claims, 7 Drawing Figures

HIGH TEMPERATURE ELECTRONIC GAIN DEVICE

BACKGROUND OF THE INVENTION

The present invention relates to vacuum tubes, and more particularly to a minute evacuated device employing thin film electrodes suitable for use in high temperature, high radiation, and high vibration environments that preclude the employment of conventional vacuum tubes or semiconductor devices. Ceramic and metal construction vacuum tubes have been employed in the past for this purpose, but their excessive size, weight, and power consumption prevent extensive employment, as in circuits requiring a great number of such devices such as computers or severe environment instrumentation.

Integrated vacuum tube structures have been proposed in the past. Exemplary of the prior art is U.S. Pat. No. 3,978,364 issued Aug. 31, 1976 to J. Dimeff et al. Such devices are known as integrated thermionic circuits, and utilize integrated circuit photodeposition processes in conjunction with vacuum tube techniques, producing a microminiature vacuum tube. In these devices there are no separate grid structures in the form of a screen as in conventional vacuum tubes. The grid, cathode, and anode are all fabricated of thin films sputtered onto an insulating substrate and then delineated by standard photolithographic techniques. These devices can withstand temperatures in excess of 500° C. with high packaging densities. Furthermore, these devices are extremely radiation resistant, allowing application thereof in high radiation environments. However, in these prior art devices, the emitted electrons obtain such large momenta within the first few microns after emission that, instead of traveling nearly perpendicular to the equipotential lines, many are not turned to travel to the anode, but "spray" in all directions.

SUMMARY OF THE INVENTION

In the present invention, the cathode and grid are thin films formed close to one another in a manner which may be best described as interdigitated. In this manner, strong grid control of emitted electrons is obtained. The anode is placed in the natural path of the electrons. It will be apparent that this structure is similar to a standard triode vacuum tube with the grid moved down into the same plane as the cathode.

Figure 3:
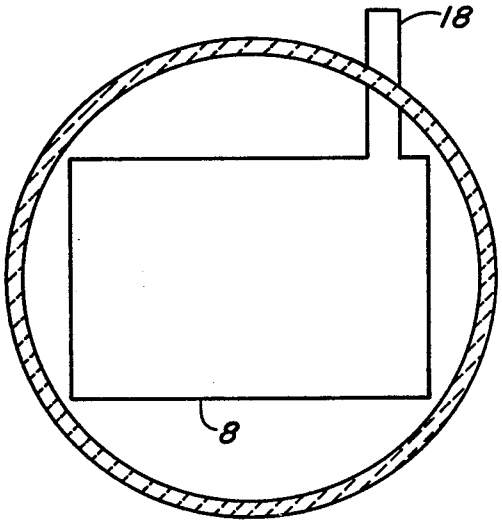
FIG. 3 is a section looking upward in FIG. 1 at the anode.
Figure 4:
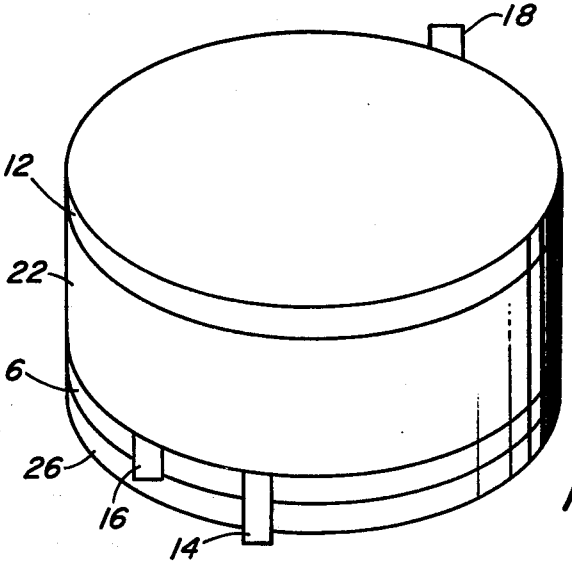
FIG. 4 illustrates the external appearance of the tube of the present invention.
Figure 1:
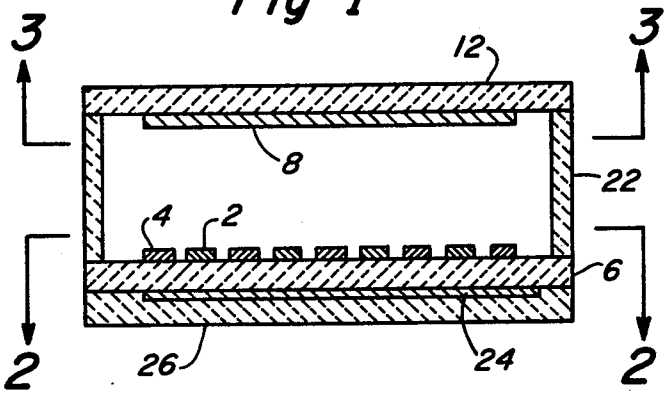
FIG. 1 is a cross section taken through the cylindrical pill box shape of the present invention.
Figure 2:
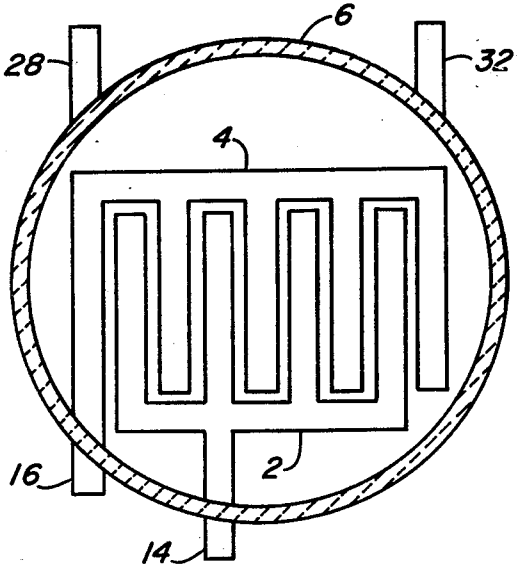
FIG. 2 is a cross section looking downward at the cathode and grid.

The structure of the vacuum tube of the present invention contemplates an interdigitated strip cathode and grid whose lengths are much greater than their thickness. The cathode potential may be assumed to be zero, and the anode is held at voltage $V_p$. It may be demonstrated that, with d representing the spacing between the anode and cathode; a the width of the cathode, the grid, and the spacing therebetween, all being equal; and $V_g$ the grid. $\mu$, the amplification factor, is defined as $$\mu = \frac{\frac{\delta E_c}{\delta V_g}}{\frac{\delta E_c}{\delta V_p}} \tag{1}$$

where $E_c$ is the electric field at the cathode, that is, $$E_c = -\nabla V(x,y) \mid y = d \tag{2}$$

$$-\frac{a}{2} < x < \frac{a}{2}$$

For the present invention this relationship reduces to an amplification factor which is a function of x. Thus, $$\mu(x) = -\frac{d}{a}\Sigma_1 - \frac{1}{2} \tag{3}$$

where $$\Sigma_1 = \sum_{n=1,3,5}^{\infty} \frac{2}{n\pi}\left(\cos\frac{n3\pi}{4} - \cos\frac{n\pi}{4}\right)\cos\frac{n\pi x}{2a}$$

The $\mu$ measured for the entire device, however, is the average of $\mu(x)$ which from Eq. 3 becomes simply $$\mu = 0.7424d/a - \tfrac{1}{2}. \tag{4}$$

Therefore, $\mu$, the electrostatic amplification factor, is linearly related to the dimensional ratio, d/a, with no other geometrical factors. This result is similar to that obtained for a conventional triode. Therefore, the desired amplification factor can simply be selected by determining the ratio d/a.

Assuming zero initial electron velocity at the cathode and zero grid current, it may be shown that $$I_p = K\left(V_g + \frac{V_p}{\mu}\right)^{3/2} \tag{5}$$

where $I_p$ is the plate current
$V_g$ is the grid voltage
$V_p$ is the plate voltage
$\mu$ is the amplification factor
K is a constant called the perveance which implies $$g_m = \frac{\delta I_p}{\delta V_g} = \frac{3}{2}K\left(V_g + \frac{V_p}{\mu}\right)^{\frac{1}{2}} \tag{6}$$

$$V_p = \text{const}$$

where $g_m$ is the transconductance, and $$R_p = \frac{2}{3K}\mu\left(V_g + \frac{V_p}{\mu}\right)^{-\frac{1}{2}} \tag{7}$$

where $R_p$ is the plate resistance.

Furthermore, $$g_m = \frac{3}{2} K^{\frac{3}{2}} I_p^{\frac{1}{2}} \quad (8)$$

and $$R_p = \frac{2}{3} \frac{\mu}{K^{\frac{3}{2}} I_p^{\frac{1}{2}}} \quad (9)$$

These equations constitute a practical set of engineering relationships for the design of a triode. The interrelationship between the various variables is determined and the dimensioning of a tube of the present invention becomes one of selecting the desired K and $\mu$.

Referring now to the drawings, a cathode 2, having a pronged shape similar to a fork, is interdigitated with a grid electrode 4, also having a pronged shape like a fork. The anode 6 overlies the cathode and grid and is separated therefrom. The cathode 2 is deposited as a thin film of molybdenum, tungsten, platinum, or other suitable refractory metals coated with. carbonates of strontium, barium, and calcium. After deposition these are heated to approximately 1000° C. while under vacuum, forming a cathode as in conventional vacuum tubes. Grid 4 is a photodeposited thin film of titanium. The substrate 6 is of a highly refractory insulating material. At present, sapphire is preferred. Anode 8 is a thin film of titanium also photodeposited upon a sapphire substrate 12. Titanium is preferred for grid 4 and anode 8 due to its refractory nature and "gettering" ability.

Each of the cathode and grid digits are 1 mil wide. The entire structure, defined on three sides by grid 4 and on the fourth side by cathode 2, is conveniently 20 mils by 20 mils in area. Similarly, anode 8 is also 20 mils by 20 mils and is spaced 100 mils from the grid and cathode structure. A tab 14 enables connection of external circuit elements to cathode 2. Similarly, a tab 16 is provided to connect grid 4 is external circuit elements. Anode 8 is provided with a tab 18 for connection to the external circuit. Grid and cathode substrate 6 and anode substrate 12 are hermetically sealed to the ends of open cylinder 22, fabricated of a suitable refractory material, preferably a ceramic. A heater 24 may be deposited upon a third sapphire disk 26 secured to the bottom of sapphire disk 6 containing the cathode and grid. Heater 24 is provided with external circuit leads 28 and 32. It will be understood that in many environments the temperature may be high enough to enable copious electron emission by cathode 2 without the necessity of a separate heater 24.

Figure 5:
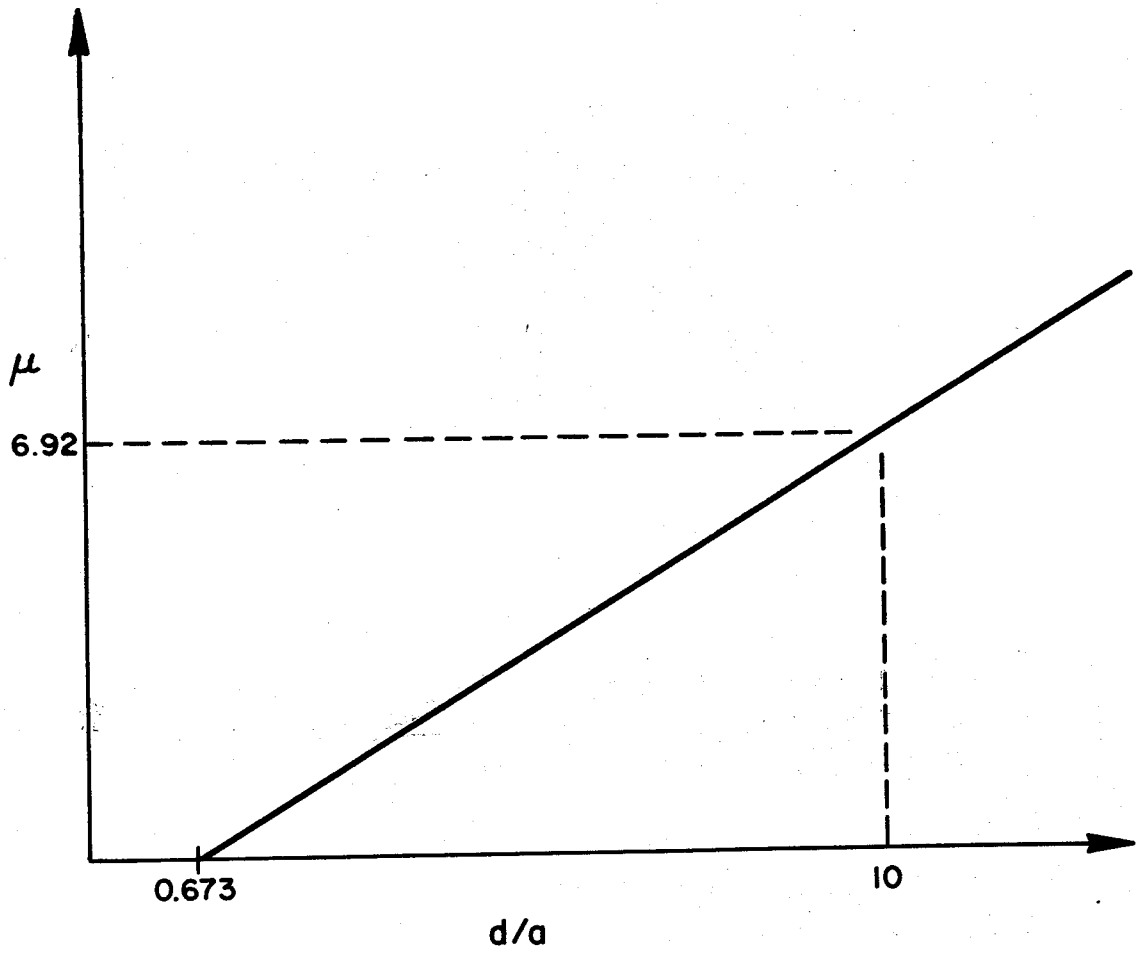
FIG. 5 is a plot of the amplification factor $\mu$, of the tube versus d/a, where d is the spacing between the anode and cathode and a is the width of the cathode, the grid, and the spacing therebetween.
Figure 6:
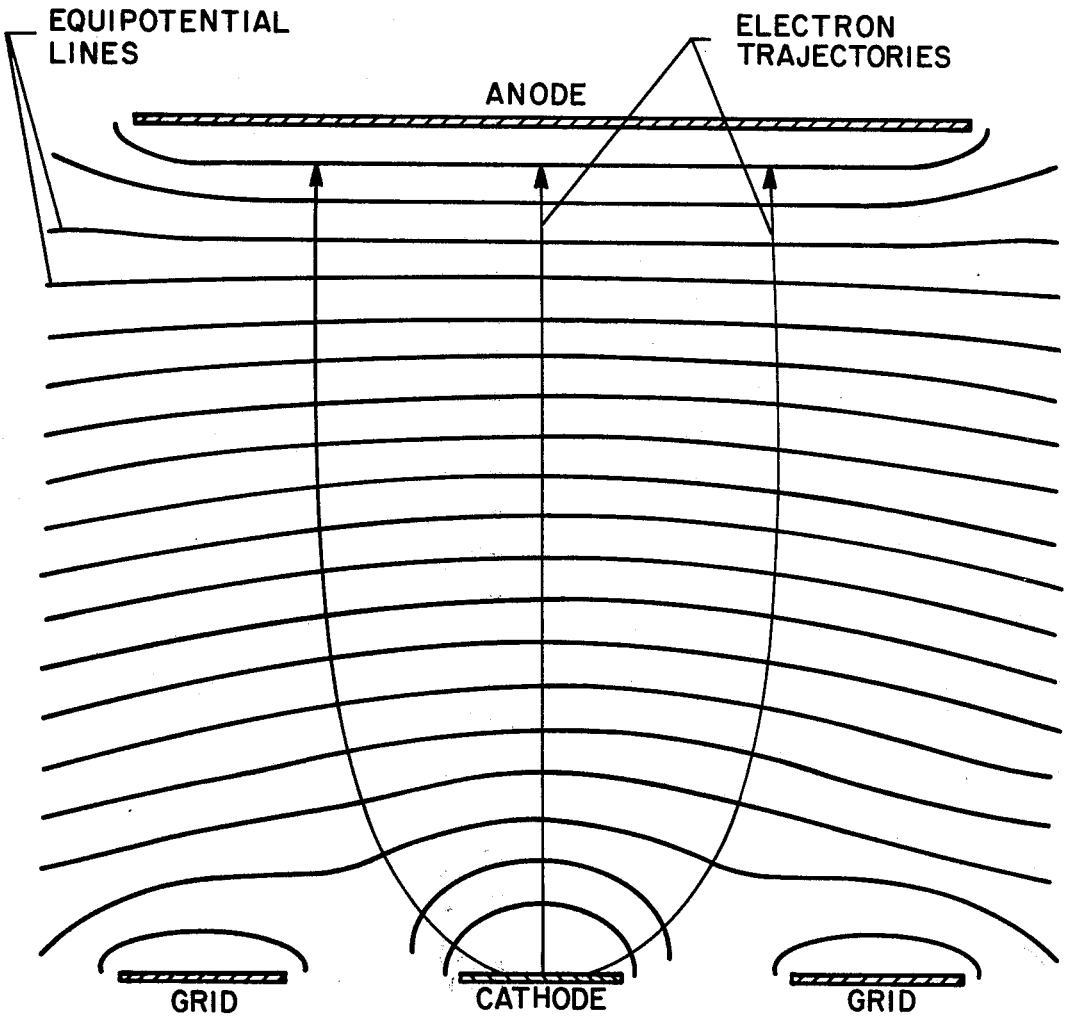
FIG. 6 illustrates the electrostatic field within the tube.
Figure 7:
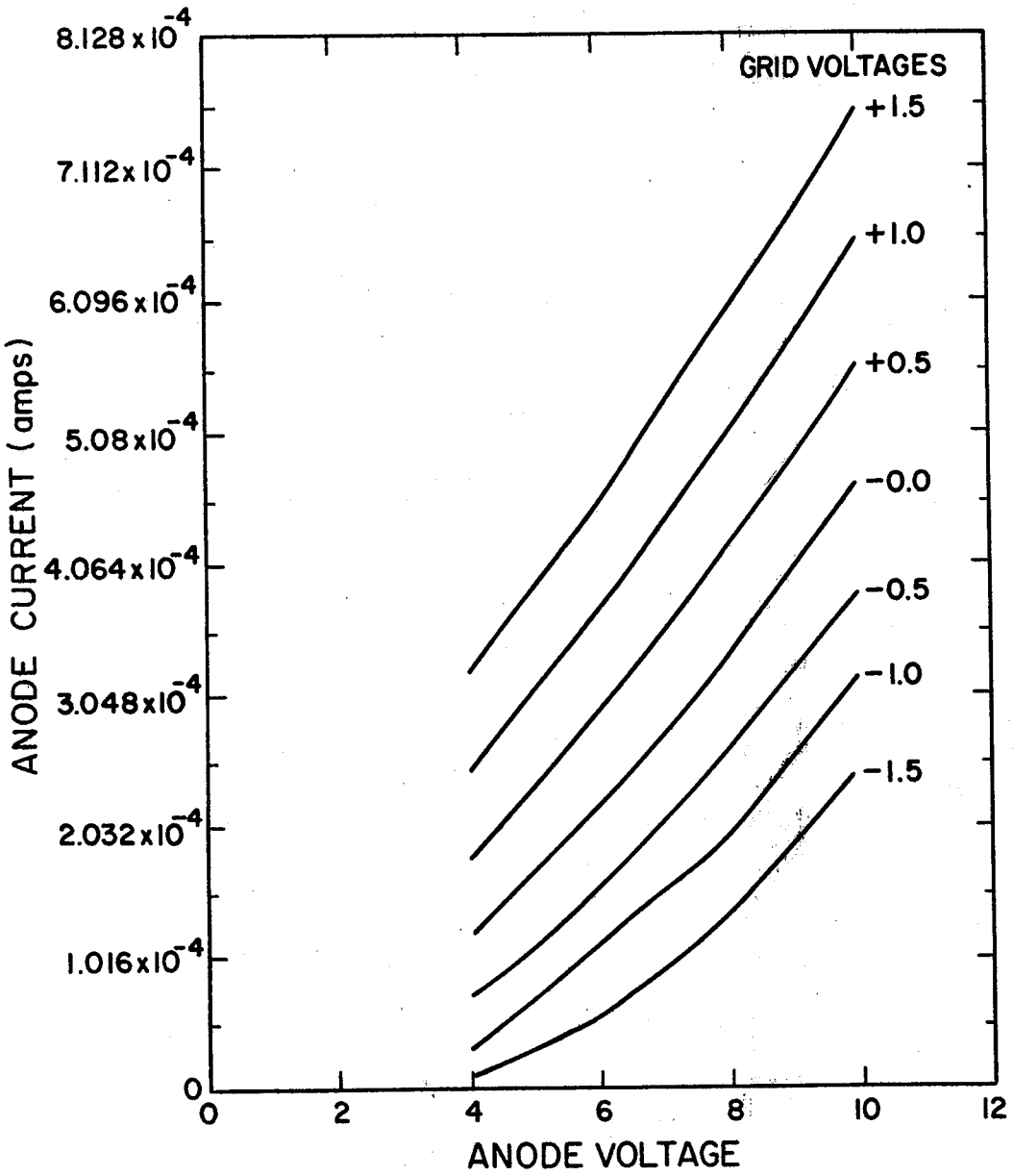
FIG. 7 illustrates the anode current versus anode voltage characteristics for varying grid voltages of the vacuum tube of the present invention.

As discussed hereinabove, d is the spacing between the anode and cathode and a is the width of each cathode digit, each grid digit, and the spacing therebetween. As illustrated in FIG. 5, $\mu$, the amplification factor of the tube, is linearly related to the ratio between d and a. FIG. 6 illustrates equipotential lines in a simplified version of the present invention with only one cathode stripe and two grid stripes. As will be apparent after study of FIG. 6, for a given anode voltage, as the grid voltage becomes more positive, plate current increases as in conventional vacuum tubes. FIG. 7 illustrates the anode current, anode voltage characteristics of a device built in accordance with the present invention. As readily apparent to one skilled in the art, these characteristic curves are similar to those depicting the characteristics of a conventional triode with a typical screen type grid structure.

The present invention eliminates the electron ballistics problems of the prior art. In addition, the present structure allows not only the design of specific device parameters, but also defines the interrelationship between parameters and operating conditions.

What we claim is:

1. An electron discharge device comprising:

an evacuated sealed envelope of refractive insulating material, said envelope having first and second planar, parallel opposed surfaces;

a forklike cathode electrode deposited on said first surface;

a forklike grid electrode interdigitally arranged with said cathode electrode deposited on said first surface;

said cathode and grid electrodes having like widths and distance from one another; and an anode deposited on said second surface.

2. An electron discharge device comprising:

first and second planar, parallel, opposed substrates of refractive electrical insulating material;

a forklike strip thermionic cathode deposited on the surface of said first substrate;

a forklike strip control electrode of refractory metal interdigitated with said cathode on said first substrate;

said forklike cathode and control electrode strips having like widths and distance from one another; and an anode electrode of refractory metal on the surface of said second substrate facing said first substrate.

3. In the device of claim 2, said strip cathode and strip control electrodes taken together have a substantially rectangular shape.

4. In the device of claim 3, said anode electrode is of substantially like dimensions and shape as said cathode and control electrodes taken together.

5. In the device of claim 4, refractory means forming an evacuated envelope with said first and second substrates.

* * * * *